US006106987A

United States Patent [19]

Hakata et al.

[11] Patent Number: 6,106,987

[45] Date of Patent: Aug. 22, 2000

[54] MAGNETIC PARTICLES AND MAGNETIC CARRIER FOR ELECTROPHOTOGRAPHIC DEVELOPER

[75] Inventors: Toshiyuki Hakata; Hiroshi Akai, both of Hiroshima-ken, Japan

[73] Assignee: Toda Kogyo Corporation, Hiroshima-ken, Japan

[21] Appl. No.: 09/404,586

[22] Filed: Sep. 24, 1999

[30] Foreign Application Priority Data

Sep. 25, 1998 [JP] Japan ..... 10-271476

[51] Int. Cl.[7] ..... G03G 9/083

[52] U.S. Cl. ..... 430/106.6; 430/108; 252/62.54

[58] Field of Search ..... 430/106.6, 108; 252/62.54

[56] References Cited

U.S. PATENT DOCUMENTS 5,766,814 6/1998 Baba et al. ..... 430/106.6

5,989,767 11/1999 Yoerger et al. ..... 430/108

6,042,982 3/2000 Hakata ..... 430/106.6

*Primary Examiner*—John Goodrow

*Attorney, Agent, or Firm*—Nixon & Vanderhye

[57] ABSTRACT

Magnetic particles of the present invention comprise:

magnetic core particles;

an intermediate layer formed on each surface of said magnetic core particles, comprising a silane-based coupling agent oligomer; and a resin composition layer formed on said intermediate layer, comprising a metal-based curing agent, a coupling agent and a silicone resin, and having an average particle size of 10 to 200 $\mu$m.

Such magnetic particles are useful for an electrophotographic magnetic carrier for an electrophotographic developer which have an excellent durability and a stable charging property.

8 Claims, No Drawings

MAGNETIC PARTICLES AND MAGNETIC CARRIER FOR ELECTROPHOTOGRAPHIC DEVELOPER

BACKGROUND OF THE INVENTION

The present invention relates to magnetic particles and a magnetic carrier for an electrophotographic developer, comprising the magnetic particles. More particularly, the present invention relates to magnetic particles for use as an electrophotographic magnetic carrier in an electrophotographic developer, an electrophotographic magnetic carrier for an electrophotographic developer which have an excellent durability and a stable charging property, using the magnetic particles, and an electrophotographic developer using the electrophotographic magnetic carrier.

In electrophotographic developing methods, a photosensitive member composed of a photoconductive material such as selenium, OPC (organic semiconductor), a-Si (amorphous silicon) or the like has been used to form an electrostatic latent image thereon by various means. Then, by using a magnetic brush method or the like, a toner having a polarity reverse to that of the latent image is attached thereon to form the latent image by the electrostatic force.

As is well known in the art, in the above developing methods, there have been used support particles called a magnetic carrier. The magnetic carrier acts for imparting an appropriate positive or negative electrical quantity to the toner by frictional electrification, and transferring the toner into a developing zone near the surface of the photosensitive member by a developing sleeve in which magnets are accommodated, using the magnetic force thereof.

In recent years, the electrophotographic developing method has been widely applied to copying machines or printers. In these apparatuses, it has been demanded to meet various requirements including not only reproduction of thin lines, small characters, photographs, color originals or the like, but also a high image quality, a high image grade, a high copying or printing speed, a continuous image formation or the like. The requirements for these properties have been estimated to become increased more and more in future.

In order to satisfy not only the applicability to various objectives but also the high image quality and the high image grade, the reduction in a particle size of the toner particles and the magnetic carrier particles, has been studied. In particular, it has been strongly demanded to provide magnetic carrier particles having an average particle size as small as 10 to 50 $\mu$m.

On the other hand, in order to satisfy the high copying or printing speed and the continuous image formation, it has been demanded to enhance the durability of these particles as developer. In the case of the magnetic carrier, there has been proposed such a method which comprises iron particles obtained by a mechanical pulverization method, an electrolytic method, a reduction method, a heat-decomposition method, a sintering method or the like; granulating and then heat-sintering various ferrite fine particles or magnetite fine particles to form granulated sintered particles; dispersing magnetic particles or magnetic particle and non-magnetic particles in a binder resin to form composite particles (hereinafter referred to merely as "magnetic core particles"); and then coating the surfaces of the obtained magnetic core particles with various resins. The above magnetic carrier has been already put into practice.

There is no end of a demand for the enhancement in properties of the electrophotographic developers. In order to continuously obtain a clear image, it is desired that the charge amount of the magnetic carrier is kept unchanged and stable even after the magnetic carrier is used for a long period of time. Specifically, when the magnetic carrier is used for a long period of time, there arises such a problem that the coating resin layer is peeled off from the surfaces of the magnetic core particles, so that the charging property of the magnetic carrier is deteriorated, whereby the magnetic carrier cannot impart an appropriate charge to the toner. Therefore, it has been demanded that the coating resin layer can be prevented from being peeled off from the surfaces of the magnetic core particles in order to enhance the durability of the magnetic carrier, thereby allowing the magnetic carrier to show a more stable charging property.

Hitherto, in order to enhance the durability of the magnetic carrier, there have been proposed a magnetic carrier obtained by forming a silicone resin composition-coating layer on the surfaces of magnetic core particles through a coupling agent layer (Japanese Patent Application Laid-Open (KOKAI) Nos. 60-19156(1985) and 62-121463 (1987), etc.); or the like.

At the present time, it has been strongly required to provide an electrophotographic magnetic carrier having an excellent durability and a stable charging property. However, such a magnetic carrier has not been obtained yet.

That is, in the above-described known magnetic carriers, since the coupling agent applied is bonded to not only hydrophilic groups such as hydroxy groups which are present on each surface of the magnetic core particles but also the silicone resin composition-coating layer formed over the coupling agent, so that the silicone resin composition-coating layer is unlikely to be peeled off as compared to the case where the silicone resin composition-coating layer is directly formed onto each surface of the magnetic core particles without coating of the coupling agent. However, as described in Comparative Examples hereinafter, when such known magnetic carriers are repeatedly used for a long period of time, the silicone resin composition-coating layer finally starts to be peeled off. Thus, the known magnetic carriers are still unsatisfactory in durability. Further, the charging property of the known magnetic carriers tends to be fluctuated.

As a result of the present inventors' earnest studies, it has been found that by forming an intermediate layer comprising a silane-based coupling agent oligomer on each surface of magnetic core particles and then forming a composition layer comprising a metal curing agent, the coupling agent and a silicone resin, on the intermediate layer, the obtained magnetic particles are useful as a magnetic carrier for an electrophotographic developer. The present invention has been attained on the basis of this finding.

SUMMARY OF THE INVENTION

It is an object of the present invention to provide a magnetic carrier exhibiting not only an excellent durability but also a stable charging property by more strongly bonding a silicone resin composition-coating layer onto each surface of magnetic core particles.

It is another object of the present invention to provide a magnetic carrier for an electrophotographic developer exhibiting not only an excellent durability but also a stable charging property.

It is a further object of the present invention to provide an electrophotographic developer having an excellent durability.

To accomplish the aims, in a first aspect of the present invention, there are provided magnetic particles having an average particle size of 10 to 200 $\mu$m, comprising:

magnetic core particles;

an intermediate layer formed on each surface of said magnetic core particles, comprising a silane-based coupling agent oligomer; and a resin composition layer formed on said intermediate layer, comprising a metal-based curing agent, a coupling agent and a silicone resin.

In a second aspect of the present invention, there is provided a magnetic carrier for an electrophotographic developer, comprising magnetic particles having an average particle size of 10 to 200 μm, comprising:

magnetic core particles;

an intermediate layer formed on each surface of said magnetic core particles, comprising a silane-based coupling agent oligomer; and a resin composition layer formed on said intermediate layer, comprising a metal-based curing agent, a coupling agent and a silicone resin.

In a third aspect of the present invention, there is provided a developer comprising a toner and a magnetic carrier which comprises magnetic particles having an average particle size of 10 to 200 μm, comprising:

magnetic core particles;

an intermediate layer formed on each surface of said magnetic core particles, comprising a silane-based coupling agent oligomer; and a resin composition layer formed on said intermediate layer, comprising a metal-based curing agent, a coupling agent and a silicone resin.

DETAILED DESCRIPTION OF THE INVENTION

Various conditions for carrying out the present invention are described below.

First, the magnetic particles according to the present invention are described.

The magnetic particles according to the present invention have an average particle size of usually 10 to 200 μm. When the average particle size is less than 10 μm, there is caused such a phenomenon that a toner is firmly adhered onto the surfaces of the magnetic particles, so that the charging property inherent to the magnetic particles is lost, i.e., a so-called spent toner. On the other hand, when the average particle size is more than 200 μm, it is difficult to obtain a clear image. In particular, in order to obtain images having a more high quality and a more high grade, the average particle size of the magnetic particles are preferably 10 to 100 μm, more preferably 10 to 50 μm.

As the magnetic core particles used in the present invention, there may be used any kind of the magnetic core particles described hereinbefore.

As the granulated sintered particles, there may be used magnetic particles such as ferrite particles containing at least one element selected from the group consisting of lithium, manganese, magnesium or the like, or magnetite particles. Specific examples of the preferred fine particles may include lithium-manganese ferrite, lithium-magnesium ferrite, magnesium ferrite and copper-zinc ferrite. In order to produce the magnetic particles having a high magnetization value, it is preferred to use the granulated sintered particles.

As the composite particles, there may be used those particles obtained by granulating a mixture composed of a resin, magnetic fine particles such as the above-mentioned ferrite fine particles or magnetite fine particles and, if required, non-magnetic fine particles such as hematite fine particles, by a kneading and pulverizing method or a polymerization method. In order to obtain a magnetic carrier having a further enhanced durability, the use of composite particles having a specific gravity as low as especially 2 to 4, is preferred.

As to weight percentages of the resin and the magnetic fine particles constituting the composite particles, it is preferred that the amount of the resin is usually 1 to 20% by weight, and the amount of the magnetic fine particles is usually 80 to 99% by weight. If required, not more than 70% by weight of the magnetic fine particles may be replaced with fine non-magnetic particles such as hematite particles.

Incidentally, the magnetic fine particles or non-magnetic fine particles used upon the production of the composite particles as the magnetic core particles, may have any particle shape including a spherical shape, a plate-like shape, an acicular shape or the like. The average particle size of the magnetic fine particles or the non-magnetic particles is preferably 0.05 to 5.0 μm. Further, in order to improve the properties of these particles such as dispersibility in resins, the magnetic fine particles or non-magnetic fine particles may be surface-treated with a coupling agent or the like to impart a hydrophilic property thereto.

The magnetic core particles may also have any particle shape such as a spherical shape, a granular shape, a plate-like shape or the like.

The average particle size of the magnetic core particles is usually 8 to 195 μm, preferably 10 to 100 μm. When the average particle size of the magnetic core particles is less than 8 μm, the particle size of the obtained magnetic particles becomes less than 10 μm. On the other hand, when the average particle size of the magnetic core particles is more than 195 μm, the particle size of the obtained magnetic particles becomes more than 200 μm.

As the silane-based coupling agent oligomers used in the present invention, there may be exemplified usually any one of dimers to decamers of silane-based coupling agents, or mixtures thereof; preferably any one of dimers to octamers of silane-based coupling agents, or mixtures thereof.

Examples of the monomers constituting the above silane-based coupling agent oligomers may include: coupling agents containing an amino group, an epoxy group, a vinyl group, a mercapto group, a halogen atom and/or an alkyl group therein. Specific examples of the silane-based coupling agents may include amino-containing silane-based coupling agents such as γ-aminopropyl trimethoxysilane, N-β-aminoethyl-γ-aminopropyl trimethoxysilane, N-β-aminoethyl-γ-aminopropylmethyl dimethoxysilane, N-phenyl-γ-aminopropyl trimethoxysilane or the like; epoxy-containing silane-based coupling agents such as γ-glycidoxypropylmethyl diethoxysilane, β-3,4-epoxycyclohexyl trimethoxysilane, γ-glycidoxypropyl trimethoxysilane or the like; vinyl-containing silane-based coupling agents such as vinyl trichlorosilane, vinyl triethoxysilane, vinyl-tris(β-methoxy) silane or the like; halogen-containing silane-based coupling agents such as dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane, β-chloroethyl trichlorosilane or the like; mercapto-containing silane-based coupling agents such as γ-mercaptopropyl trimethoxysilane; or alkyl-containing silane-based coupling agents such as trimethyl silane or the like.

As the silane-based coupling agent oligomers, either commercially available products or synthesized products may be used in the present invention.

Examples of the commercially available products are as follows. As amino-containing silane-based coupling agent oligomers, there may be exemplified MS3201 (tradename, produced by Chisso Co., Ltd.), MS3301 (tradename, produced by Chisso Co., Ltd.), KBP-40 (tradename, produced by Shin-Etsu Chemical Co., Ltd.), KBP-43 (tradename, produced by Shin-Etsu Chemical Co., Ltd.) or the like. As epoxy-containing silane-based coupling agent oligomers, there may be exemplified MS5101 (tradename, produced by Chisso Co., Ltd.), MS5102 (tradename, produced by Chisso Co., Ltd.) or the like. As mercapto-containing silane-based coupling agent oligomers, there may be exemplified X-12-414 (tradename, produced by Shin-Etsu Chemical Co., Ltd.) or the like.

The amount of the silane-based coupling agent oligomer used is usually 0.01 to 3% by weight, preferably 0.01 to 2.5% by weight based on the weight of the magnetic core particles.

When the amount of the silane-based coupling agent oligomer used is less than 0.01% by weight, it may become difficult to more strongly bond the silicone resin composition-coating layer onto each surface of the magnetic core particles.

When the amount of the silane-based coupling agent oligomer used is more than 3% by weight, the silicone resin composition-coating layer can be more strongly bonded onto each surface of the magnetic core particles, but the obtained effect is already saturated and, therefore, the use of such a large amount of the silane-based coupling agent oligomer is unnecessary and meaningless.

The coating resin composition used for the magnetic particles according to the present invention, comprises a silicone resin, a metal-based curing agent and a silane-based coupling agent, titanium-based coupling agent or aluminum-based coupling agent.

As to the silicone resins, in the consideration of the durability of the obtained magnetic particles, the ratio of trifunctional silicone (hereinafter referred to merely as "T") to bifunctional silicone (hereinafter referred to merely as "D") is preferably in the range of 95:5 to 40:60, more preferably 95:5 to 50:50.

The amount of the coating resin composition is usually 0.05 to 10% by weight based on the weight of the magnetic core particles. When the amount of the coating resin composition is less than 0.05% by weight, the obtained coating resin layer tends to become insufficient and non-uniform, so that it may be difficult to enhance the durability of the magnetic particles. On the other hand, when the amount of the coating resin composition applied is too large, the obtained coating resin layer tends to be peeled off from the surfaces of the magnetic core particles, so that it may be difficult to produce a magnetic carrier having a stable charging property. The amount of the coating resin composition is preferably 0.1 to 10% by weight, more preferably 0.2 to 5% by weight based on the weight of the magnetic core particles.

As to the metal-based curing agent used in the present invention, there may be used metal carboxylates such as di-n-butyl tin dilaurate or the like; metal alkoxides; or the like.

The amount of the metal-based curing agent used is preferably 0.05 to 1.0% by weight, more preferably 0.05 to 0.5% by weight based on the solid content of the silicone resin. When the amount of the metal-based curing agent used is less than 0.05% by weight, the curing speed of the silicone resin may be low, so that the magnetic carrier particles tend to be agglomerated together, resulting in low yield. On the other hand, when the amount of the metal-based curing agent used is more than 1.0% by weight, the obtained coating resin layer may become brittle, resulting in deteriorated durability thereof.

As the metal-based curing agent, it is preferred to use the metal alkoxides. This is because the metal alkoxides allows a silicone resin to be sufficiently cured even when the amount of the metal alkoxide used is as small as preferably 0.05 to 0.5% by weight, more preferably 0.05 to 0.3% by weight based on the weight of the solid content of the silicone resin, so that it becomes possible to form a uniform and satisfactory resin composition-coating layer, i.e., a strongly bonded resin composition-coating layer.

The metal alkoxides of the coating resin composition used in the present invention, are represented by the general formula:

$$(RO)_nM$$

wherein R is a $C_1$ to $C_{16}$ alkyl group; M is Al, Ti, Na, K, Ca, Zn or Fe; and n is an integer of 1 to 4.

In the consideration of industrial or economical uses, the R is preferably a $C_2$ to $C_8$ alkyl group, more preferably a $C_2$ to $C_4$ alkyl group. In order to further enhance the durability of the coating resin layer, the M is preferably Al or Ti. Specific examples of the metal alkoxides usable in the present invention, may include aluminum-tri-n-butoxide (n=4, M=Al), aluminum-tri-ethoxide (n=2, M=Al), aluminum-tri-sec-butoxide (n=4, M=Al), aluminum-tri-isopropoxide (n=3, M=Al), titanium-tetra-n-butoxide (n=4, M=Ti), titanium-tetraethoxide (n=2, M=Ti), titanium-tetra-iso-propoxide (n=3, M=Ti) or the like.

The coupling agent contained in the coating resin composition used in the present invention may be composed of at least one coupling agent selected from the group consisting of silane-based coupling agents, titanium-based coupling agents and aluminum-based coupling agents.

As the silane-based coupling agents used in the coating resin composition of the present invention, there may be exemplified coupling agents containing an amino group, an epoxy group, a vinyl group, a mercapto group, a halogen atom and/or an alkyl group therein. Specific examples of the silane-based coupling agents may include amino-containing silane-based coupling agents such as γ-aminopropyl trimethoxysilane, N-β-aminoethyl-γ-aminopropyl trimethoxysilane, N-β-aminoethyl-γ-aminopropylmethyl dimethoxysilane, N-phenyl-γ-aminopropyl trimethoxysilane or the like; epoxy-containing silane-based coupling agents such as γ-glycidoxypropylmethyl diethoxysilane, β-3,4-epoxycyclohexyl trimethoxysilane, γ-glycidoxypropyl trimethoxysilane or the like; vinyl-containing silane-based coupling agents such as vinyl trichlorosilane, vinyl triethoxysilane, vinyl-tris(β-methoxy) silane or the like; halogen-containing silane-based coupling agents such as dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane, β-chloroethyl trichlorosilane or the like; mercapto-containing silane-based coupling agents such as γ-mercaptopropyl trimethoxysilane; or alkyl-containing silane-based coupling agents such as trimethyl silane or the like. In the case where the charge amount of a negative toner is required to increase, the use of the amino-containing silane-based coupling agents is preferable. Also, in the case where the charge amount of the toner is to be kept unchanged, the use of the epoxy-containing silane-based coupling agents is preferable.

As the titanium-based coupling agents, there may be exemplified:

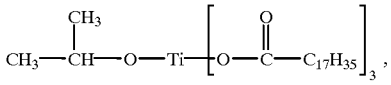

(Isopropyloxy-titanium-tristearate)

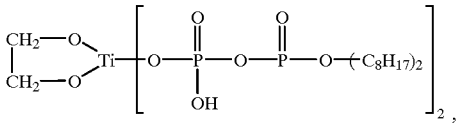

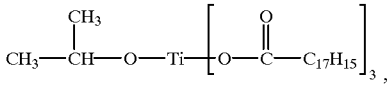

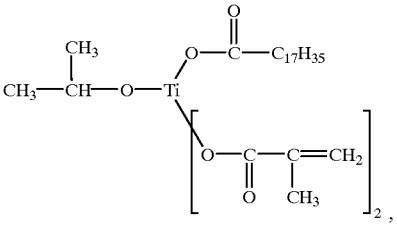

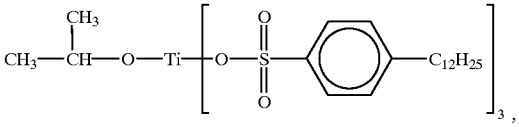

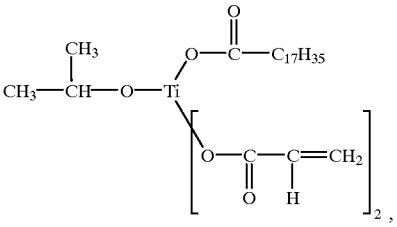

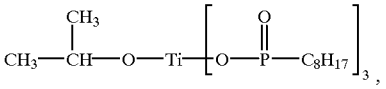

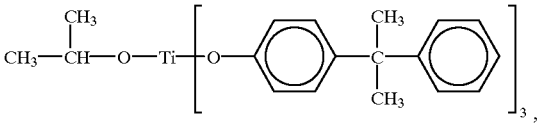

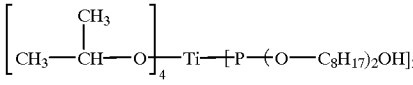

or the like.

Since the isopropyloxy-titanium-tristearate exhibits an excellent water-repellency, the obtained magnetic carrier can be prevented from being fluctuated in charging property due to moisture absorption.

As the aluminum-based coupling agents, there may be exemplified:

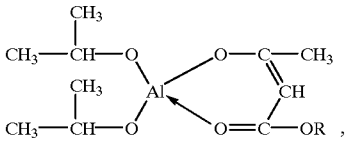

or the like.

The amount of the coupling agent used is preferably 0.1 to 20.0% by weight, more preferably 0.1 to 10% by weight based on the solid content of the silicone resin. When the amount of the coupling agent used is less than 0.1% by weight, the curing speed of the silicone resin may be low, so that it may be difficult to form the aimed coating resin layer having an excellent durability, and the obtained magnetic particles tend to agglomerate together. On the other hand, when the amount of the coupling agent used is more than 20.0% by weight, the obtained coating resin layer may become brittle, resulting in deteriorated durability, so that the obtained magnetic carrier tends to show an unstable charging property.

In the coating resin composition used in the present invention, at least two of the metal-based curing agent, the coupling agent and the silicone resin may be interacted to each other.

Next, the process for producing the magnetic particles, is explained.

The magnetic particles according to the present invention can be produced by first mixing the magnetic core particles with a solution containing the silane-based coupling agent oligomer in a solvent while stirring, and then adding to the obtained suspension, a coating solution prepared by diluting a mixture of a silicone resin, a metal-based curing agent and the coupling agent with toluene so as to adjust a solid content of the mixture to 5 to 30% by weight and by controlling the amounts of the respective components added so as to adjust the gel time thereof to 2 to 5 hours, thereby coating each surface of the magnetic core particles with the above coating solution through the layer composed of the silane-based coupling agent oligomer. A substantially whole amount of the solution containing the silane-based coupling agent oligomer in the solvent is adhered onto each surface of the magnetic core particles so as to form the layer composed of the silane-based coupling agent oligomer, and a substantially whole amount of the coating solution is adhered onto each surface of the magnetic core particles through the layer composed of the silane-based coupling agent oligomer so as to form a silicone resin composition-coating layer thereon.

The silane-based coupling agent oligomer used in the present invention may be commercially available products as described above. Alternatively, the silane-based coupling agent oligomer may be produced by subjecting the above-described silane-based coupling agent as a constituting monomer to hydrolysis/condensation reaction using a known catalyst such as acids or bases for oligomerization thereof. More specifically, the silane-based coupling agent is dissolved in a solvent to form a solution having a concentration of 1 to 20% by weight, and then the obtained solution is stirred at a liquid temperature of 30 to 50° C. The stirring time is preferably 2 to 3 hours.

It is preferred that the hydrolysis/condensation reaction be conducted in the presence of a solvent, because the obtained solution can be immediately used for treating the magnetic core particles.

As the solvent used in the hydrolysis/condensation reaction, isopropyl alcohol or ethanol is preferred.

Meanwhile, the degree of oligomerization of the silane-based coupling agent oligomer can be determined from the molecular weight of the obtained oligomer which may be measured by a gas chromatography mechanical spectrometer, and the molecular weight of the monomer used.

When the solid content of the coating solution is less than 5% by weight, the removal of the solvent such as toluene, etc., may need a long period of time, resulting in industrially and economically disadvantageous process. On the other hand, when the solid content of the coating solution is more than 30% by weight, it may be difficult to form a sufficient and uniform coating resin layer composed of the coating resin composition on the surfaces of the magnetic core particles.

The amount of the coating solution added is preferably 0.05 to 10.0% by weight (calculated as solid content) based on the weight of the magnetic core particles. When the amount of the coating solution added is less than 0.05% by weight, there is a tendency that the magnetic core particles are insufficiently and non-uniformly coated with the coating resin composition. On the other hand, when the amount of the coating solution added is more than 10.0% by weight, the obtained magnetic carrier may show a too high electrical resistance, thereby causing deteriorated images such as charge-up or the like.

The magnetic particles according to the present invention have (1) a true specific gravity of usually 2 to 7, preferably 2.5 to 5.5; (2) a volume resistivity of usually not less than $10^7$ Ω·cm, preferably $10^8$ to $10^{16}$ Ω·cm; (3) a saturation magnetization value of usually 20 to 90 emu/g, preferably 25 to 90 emu/g; and (4) a durability (change in charge amount) of usually not more than 12%, preferably not more than 8%.

A magnetic carrier of the present invention comprises the magnetic particle according to the present invention. The properties of the magnetic carrier of the present invention, such as an average particle size, a true specific gravity, a volume resistivity, a saturation magnetization value, a durability (change in charge amount) or the like are the same as the above-mentioned magnetic particle.

An electrophotographic developer according to the present invention comprises the magnetic carrier and a toner. The amount of the magnetic carrier used is 80 to 97 parts by weight and the amount of the toner used is 3 to 20 parts by weight.

The important point of the present invention is such a fact that the magnetic particles obtained by coating on each surface of the magnetic core particles with the coating resin composition comprising the silicone resin, the metal-based curing agent and the coupling agent, through the silane-based coupling agent oligomer layer, can show an excellent durability and a stable charging property.

The reason why the magnetic particles according to the present invention can exhibit an excellent durability is considered as follow. That is, upon forming the silicone resin composition-coating layer on the surface of the magnetic carrier, when the magnetic core particles are treated with the silane-based coupling agent oligomer, the silane-based coupling agent oligomer applied can be bonded to each surface of the magnetic core particles at a larger number of positions than those of conventionally known coupling agent monomers, thereby establishing a more strong bond therebetween. Therefore, it is possible to strongly bond the silicone resin composition-coating layer to each surface of the magnetic core particles through the silane-based coupling agent oligomer.

The reason why the magnetic particles according to the present invention can exhibit a stable charging property, is considered as follows. That is, due to the improved durability of the magnetic particles, the resin composition-coating layer is unlikely to be peeled off, and further the transfer of the coupling agent which adversely affects a charging amount of the magnetic particles can be inhibited. Namely, in the magnetic particles according to the present invention, due to the fact that the silane-based coupling agent oligomer is strongly bonded to each surface of the magnetic core particles, the silane-based coupling agent oligomer can be prevented from being eluted out into the solvent or from being separated from each surface of the magnetic core particles and transferred into the resin composition-coating layer, in the subsequent silicone resin-coating process.

Since the magnetic particles according to the present invention exhibit an excellent durability, the resin composition-coating layer can be inhibited from being peeled off from each surface of the magnetic core particles even when repeatedly used for a long period of time. Further, due to the fact that eluting-out or transferring of the coupling agent which adversely affect the charging amount of the magnetic particles is effectively inhibited, the obtained magnetic particles can show a stable charging property. Accordingly, the magnetic particles according to the present invention can be suitably used as a magnetic carrier for an electrophotographic developer.

EXAMPLES

The present invention is described in more detail by Examples and Comparative Examples, but the Examples are only illustrative and, therefore, not intended to limit the scope of the present invention.

Various properties were evaluated by the following methods.

(1) The average particle size of particles in the following Examples and Comparative Examples is expressed by the value measured by a laser diffraction-type granulometer (manufactured by Horiba Seisakusho Co., Ltd.). Further, the particle shape of the particles was observed by a scanning electron microscope (S-800, manufactured by Hitachi Ltd.).

(2) The saturation magnetization is expressed by the value measured by "Vibration Sample-type Magnetometer VSM-3S-15 (manufactured by Toei Kogyo Co., Ltd.) when applying an external magnetic field of 10 kOe.

(3) The true specific gravity is expressed by the value measured by a multi-volume densitometer (manufactured by Micromeritex Co., Ltd.).

(4) The volume resistivity is expressed by the value measured by a high-resistance meter (4329A, manufactured by Yokogawa-Hewlett Packard Co., Ltd.).

(5) The durability test was conducted as follows.

50 g of magnetic carrier particles were charged into a 100 cc glass sampling bottle, and the bottle was then capped. Thereafter, the sampling bottle was shaken for 10 minutes by a paint conditioner (manufactured by Red Devil Co., Ltd.). The charge amounts of each sample before and after the shaking were measured.

(6) The charge amount was measured as follows.

95 parts by weight of magnetic carrier particles and 5 parts by weight of the toner produced in Example 2 were intimately mixed with each other, and then the charge amount of the magnetic carrier particles was measured by a blow-off charge-measuring apparatus (manufactured by Toshiba Chemical Co., Ltd.).

(7) The yield of magnetic particles composed of magnetic core particles and a coating resin layer formed on each surface thereof, is expressed by the percentage obtained by dividing the amount of the magnetic particles passed through sieves having sieve openings of 44 μm (in case of magnetic core particles A), 63 μm (in case of magnetic core particles B), 63 μm (in case of magnetic core particles C), 75 μm (in case of magnetic core particles D) and 75 μm (in case of magnetic core particles E), respectively, by the amount of the magnetic particles before passing through the sieves.

Example 1

Production of Magnetic Core Particles

One kilogram of spherical magnetite particles (average particle size: 0.24 μm) were charged into a Henschel mixer. While intimately stirring the magnetite particles, 7.5 g of N-β-(aminoethyl)-γ-aminopropylmethyl dimethoxysilane KBM-602 (produced by Shin-Etsu Chemical Co., Ltd.) (hereinafter referred to as a silane-based coupling agent a) was added thereto, and then both components were intimately mixed together, thereby coating the surfaces of the spherical magnetite particles with the silane-based coupling agent.

Separately, 50 g of phenol, 75 g of 37% formalin, 400 g of the above spherical magnetite particles subjected to a lipophilic treatment, 15 g of 25% ammonia water and 50 g of water were charged into an one-liter four-neck flask, and heated to 85° C. for 60 minutes while stirring. At that temperature, the resultant mixture was reacted and cured, thereby producing composite particles composed of the phenol resin and the spherical magnetite particles.

Next, the contents of the flask were cooled to 30° C. and then 0.5 liter of water added thereto. Thereafter, a supernatant liquid was removed therefrom, and a remaining precipitate was washed with water and air-dried.

The obtained product was further dried at a temperature of 150 to 180° C. under reduced pressure (not more than 5 mmHg), thereby obtaining composite particles (hereinafter referred to as "composite particles A").

The thus obtained composite particles A were spherical particles (sphericity: 1.1:1) containing magnetite particles in an amount of 88% by weight. It was confirmed that the obtained composite particles had an average particle size of 18 μm, a specific gravity of 3.55, a saturation magnetization value of 75 emu/g and a volume resistivity of $1\times10^{8}$ Ω·cm.

Treatment of Magnetic Core Particles With Silane-Based Coupling Agent Oligomer Solution 1.0 g of γ-aminopropyl trimethoxysilane KBM-903 (tradename, produced by Shin-Etsu Chemical Co., Ltd.) as a silane-based coupling agent (hereinafter referred to as a silane-based coupling agent b) was charged into a flask into which 50 g of isopropyl alcohol was previously introduced. After a small amount of acetic acid/water mixed solution was added to the flask while stirring, the obtained solution was further stirred for 3 hours while maintaining the liquid temperature at 40° C. so as to subject the solution to hydrolysis/condensation reaction, thereby producing a solution containing an oligomer of the silane-based coupling agent b in isopropyl alcohol.

As a result of the measurement of the degree of oligomerization of the silane-based coupling agent oligomer by using a gas chromatography mechanical spectrometer GCMS-QP5050 (manufactured by Shimazu Limited), it was confirmed that the silane-based coupling agent oligomer was a mixture composed of dimer, trimer and tetramer of γ-aminopropyl trimethoxysilane.

Next, one kilogram of the composite particles A were charged into a universal stirrer (5XDML, manufactured by Dalton Co., Ltd.), and stirred until the liquid temperature reached 50° C. Thereafter, the previously prepared solution containing the silane-based coupling agent oligomer in isopropyl alcohol was added to the composite particles A, and the obtained mixture was stirred.

After stirring for one hour, the mixture was heated to 80° C., and then further stirred at that temperature for one hour so as to treat the magnetic core particles with the solution, thereby forming a layer composed of the silane-based coupling agent oligomer on each surface of the magnetic core particles.

The amount of the layer composed of the silane-based coupling agent oligomer was 0.1% by weight based on the weight of the magnetic core particles.

Coating of Magnetic Core Particles With Silicone Resin

After the obtained particles were cooled again to 50° C., a solution prepared by diluting a mixture comprising 30 g (calculated as solid content) of a silicone resin (T/D unit ratio=90/10), 0.03 g of aluminum-tri-sec-butoxide as a metal-based curing agent (hereinafter referred to as "metal-based curing agent g) and 0.7 g of the coupling agent b, with toluene so as to adjust the concentration of the silicone resin as a solid content to 20%, was added thereto. Successively, the obtained suspension was stirred at the same temperature for one hour, and then heat-treated at 200° C. for 2 hours in an inert atmosphere using a nitrogen gas, thereby forming a silicone resin composition-coating layer containing the metal-based curing agent g and the coupling agent b on each surface of the magnetic core particles through the layer composed of the coupling agent oligomer. The yield was 97%, and it was confirmed that the coating with the silicone resin was satisfactory and uniform. Various properties of the obtained magnetic carrier are shown in Table 3.

As a result of the observation by an electron microscope, it was confirmed that the magnetic core particles were satisfactorily and uniformly coated with the silicone resin, and the amount of the silicone resin adhered was 2.5% by weight based on the weight of the magnetic core particles. The obtained magnetic particles had an average particle size of 19 μm, a bulk density of 1.72 g/ml, a true specific gravity of 3.53, an electrical resistance value of $5\times10^{14}$ Ω·cm, a saturation magnetization value of 74 emu/g and a percentage of change in charge amount of 5% (initial charge: −37 μC/g; charge after shaking: −35 μC/g).

Example 2

| <Production of toner> | |
|---|---|
| Polyester resin obtained by the condensation of propoxylated bisphenol and fumaric acid | 100 parts by weight |
| Phthalocyanine pigment | 4 parts by weight |
| Di-tert-butyl salicylate chromium complex | 4 parts by weight |

The above components were sufficiently premixed with each other by a Henschel mixer, and melt-kneaded by a twin-screw extrusion-type kneader. After cooling, the obtained mixture was crushed into coarse particles by a hammer mill, and then finely pulverized by an air jet-type pulverizer. The obtained fine particles were subjected to classification, thereby obtaining a negative cyan-colored particles (weight average particle size: 8 μm). 100 parts by weight of the obtained color particles were mixed with 1.0 parts by weight of titanium oxide fine particles by a Henschel mixer, thereby obtaining a cyan toner.

Production of Electrophotographic Developer 95 parts by weight of a magnetic carrier composed of the magnetic particles obtained in Example 1 was mixed with 5 parts by weight of the above-obtained toner, thereby producing an electrophotographic developer.

Examples 3 to 8 and Comparative Examples 1 to 3

First, magnetic core particles A to E were prepared.

The production conditions of composite particles B and C as magnetic core particles are shown in Table 1, and the properties of the magnetic core particles B to E are shown in Table 2.

The same procedure as defined in Example 1 was conducted except that kind of the magnetic core particles, use or non-use of the treatment with silane-based coupling agent oligomer, kind and amount of the silane-based coupling agent oligomer treated, kind and amount of the silicone resin used, addition or non-addition, kind and amount of the metal-based curing agent used, and kind and amount of the coupling agent used, were changed variously, thereby obtaining a magnetic carrier.

The main conditions are shown in Table 3, and various properties of the obtained magnetic carrier are shown in Table 4.

Incidentally, in Comparative Example 3, a known silane-based coupling agent monomer was used instead of the silane-based coupling agent oligomer.

| | |
|---|---|
| <Coupling agent> | |
| Coupling agent a: | N-β-(aminoethyl)-γ-aminopropylmethyl dimethoxysilane (tradename: KBM602, produced by Shin-Etsu Chemical Co., Ltd.) |
| Coupling agent b: | γ-aminopropyltridimethoxysilane (tradename: KBM903, produced by Shin-Etsu Chemical Co., Ltd.) |
| Coupling agent c: | N-phenyl-γ-aminopropyl trimethoxysilane (tradename: KBM573, produced by Shin-Etsu Chemical Co., Ltd.) |
| Coupling agent d: | γ-glycidoxypropyl trimethoxysilane (tradename: KBM403, produced by Shin-Etsu Chemical Co., Ltd.) |
| Coupling agent e: | γ-mercaptoproryltimethoxysilane (tradename: KBM803, produced by Shin-Etsu Chemical Co., Ltd.) |
| Coupling agent f: | Isopropyloxy-titanium-tristealate (tradename: KR-TTS, produced by Ajinomoto Co., Ltd.) |
| <Metal-based curing agent> | |
| Metal-based curing agent g: | Aluminum-tri-sec-butoxide |
| Metal-based curing agent h: | Titanium-tetra-n-butoxide |
| Metal-based curing agent i: | Di-n-butyltin dilaurate |

TABLE 1

| | Production of composite particles | | | | | | | | | |
|---|---|---|---|---|---|---|---|---|---|---|
| | Magnetic fine particles | | | | | Non-magnetic particles | | | | |
| Kind of | | | Lipophilic-treating agent | | | | | Lipophilic-treating agent | | |
| magnetic core particles | Kind | Particle size (μm) | Kind | Amount treated (wt. %) | Amount (g) | Kind | Particle size (rb) (μm) | Kind | Amount treated (wt. %) | Amount (g) |
| B | Spherical magnetite | 0.31 | KBM-602 | 0.75 | 160 | Granular hematite | 0.40 | KBM-403 | 0.75 | 240 |
| C | Spherical magnetite | 0.24 | KBM-403 | 0.5 | 400 | — | — | — | — | — |

| Kind of | Production of composite particles | | | | | | |
|---|---|---|---|---|---|---|---|
| magnetic core | Phenols | 37% formalin | Suspension stabilizer | | Basic catalyst | | Water |
| particles | Amount (g) | Amount (g) | Kind | Amount (g) | Kind | Amount (g) | Amount (g) |
| B | 45 | 67 | — | — | Aqueous ammonia | 14 | 50 |
| C | 45 | 67 | Calcium fluoride | 1.0 | Aqueous ammonia | 14 | 45 |

Upon conducting the durability test, the particles obtained in Comparative Example 1 which were composed of the magnetic core particles coated with the silicone resin, showed a large change in charge amount. As a result, it is considered that the segregation of the coupling agent was caused in the coating resin layer, so that the coating resin layer was peeled off when exposed to mechanical impact upon the durability test.

Incidentally, the coupling agents a to f and the metal-based curing agent g to i as shown in Table 3, represent the following compounds, respectively.

TABLE 2

| | Kind of magnetic core particles | Average particle size (μm) |
|---|---|---|
| B | Composite particles | 35 |
| C | Composite particles | 40 |
| D | Ferrite granulated sintered particles (CuO: 15 mol %, ZnO: 15 mol %, $Fe_2O_3$: 70 mol %) | 50 |
| E | Ferrite granulated sintered particles ($Li_2CO_3$: 10 mol %, $MnCO_3$: 15 mol %, $Fe_2O_3$: 75 mol %) | 45 |

TABLE 2-continued

| Kind of magnetic core particles | Shape | Sphericity (maximum diameter/minimum diameter) | Specific gravity |
|---|---|---|---|
| B | Spherical | 1.2 | 3.58 |
| C | Spherical | 1.1 | 3.56 |
| D | Spherical | 1.3 | 5.12 |
| E | Spherical | 1.3 | 5.10 |

| Kind of magnetic core particles | Content of magnetic particles (wt. %) | Content of non-magnetic particles (wt. %) | Saturation magnetization (emu/g) | Volume resistivity (Ω · cm) |
|---|---|---|---|---|
| B | 35.1 | 52.5 | 31 | $4 \times 10^{12}$ |
| C | 88.1 | 0 | 76 | $2 \times 10^{7}$ |
| D | 100 | 0 | 68 | $2 \times 10^{8}$ |
| E | 100 | 0 | 63 | $5 \times 10^{9}$ |

TABLE 3

| Examples and Comparative Examples | Magnetic carrier: Magnetic core particles Kind | Magnetic core particles Amount (g) | Silane-based coupling agent oligomer Kind | Silane-based coupling agent oligomer Amount (g) |
|---|---|---|---|---|
| Example 3 | A | 1,000 | a/d | 0.5/0.5 |
| Example 4 | B | 1,000 | a | 0.8 |
| Example 5 | C | 1,000 | c | 0.6 |
| Example 6 | C | 1,000 | c | 0.6 |
| Example 7 | D | 1,000 | b | 0.3 |
| Example 8 | E | 1,000 | b/e | 0.2/0.2 |
| Example 9 | B | 1,000 | a | 1.0 |
| Comparative Example 1 | A | 1,000 | — | — |
| Comparative Example 2 | A | 1,000 | b | 1.2 |
| Comparative Example 3 | A | 1,000 | b(monomer) | 1.0 |

| Examples and Comparative Examples | Magnetic carrier Coating with silicone resin: Silicone resin T/D unit ratio | Silicone resin Solid content (g) | Metal-based curing agent Kind | Metal-based curing agent Amount (g) |
|---|---|---|---|---|
| Example 3 | 95/5 | 30 | h | 0.05 |
| Example 4 | 100/0 | 25 | i | 0.03 |
| Example 5 | 80/20 | 20 | g | 0.07 |
| Example 6 | 60/40 | 15 | h | 0.05 |
| Example 7 | 90/10 | 15 | i | 0.05 |
| Example 8 | 90/10 | 10 | i | 0.02 |
| Example 9 | 90/10 | 10 | i | 0.05 |
| Comparative Example 1 | 90/10 | 30 | h | 0.05 |
| Comparative Example 2 | 90/10 | 30 | — | — |
| Comparative Example 3 | 90/10 | 30 | i | 0.05 |

| Examples and Comparative Examples | Magnetic carrier: Coating with silicone resin Coupling agent Kind | Coupling agent Amount (g) | Yield |
|---|---|---|---|
| Example 3 | a | 1.5 | 96 |
| Example 4 | a | 0.8 | 98 |

TABLE 3-continued

| | | | |
|---|---|---|---|
| Example 5 | c | 0.6 | 98 |
| Example 6 | c | 0.3 | 98 |
| Example 7 | a | 0.3 | 98 |
| Example 8 | a | 0.2 | 98 |
| Example 9 | f | 0.2 | 98 |
| Comparative Example 1 | b | 0.3 | 97 |
| Comparative Example 2 | a | 0.3 | 78 |
| Comparative Example 3 | a | 0.3 | 96 |

TABLE 4

| Examples and Comparative Examples | Magnetic carrier: Average particle size (μm) | Bulk density (g/ml) | Specific gravity | Coating amount (wt. %) |
|---|---|---|---|---|
| Example 3 | 19 | 1.73 | 3.53 | 2.7 |
| Example 4 | 35 | 1.80 | 3.56 | 2.0 |
| Example 5 | 40 | 1.89 | 3.56 | 1.7 |
| Example 6 | 40 | 1.90 | 3.57 | 1.2 |
| Example 7 | 51 | 2.14 | 5.12 | 1.1 |
| Example 8 | 45 | 2.10 | 5.10 | 1.0 |
| Example 9 | 35 | 1.80 | 3.55 | 0.9 |
| Comparative Example 1 | 23 | 1.65 | 3.52 | 2.2 |
| Comparative Example 2 | 22 | 1.66 | 3.53 | 2.2 |
| Comparative Example 3 | 20 | 1.71 | 3.53 | 2.4 |

| Examples and Comparative Examples | Magnetic carrier: Conductivity (Ω · cm) | Saturation magnetization (emu/g) |
|---|---|---|
| Example 3 | $8 \times 10^{13}$ | 74 |
| Example 4 | $7 \times 10^{13}$ | 31 |
| Example 5 | $4 \times 10^{12}$ | 75 |
| Example 6 | $8 \times 10^{10}$ | 76 |
| Example 7 | $7 \times 10^{12}$ | 65 |
| Example 8 | $6 \times 10^{12}$ | 62 |
| Example 9 | $5 \times 10^{12}$ | 31 |
| Comparative Example 1 | $5 \times 10^{12}$ | 72 |
| Comparative Example 2 | $3 \times 10^{9}$ | 73 |
| Comparative Example 3 | $2 \times 10^{12}$ | 73 |

| Examples and Comparative Examples | Magnetic carrier: Change in charging amount Initial (μC/g) | After shaking (μC/g) | Rate of change (%) |
|---|---|---|---|
| Example 3 | −60 | −58 | 3 |
| Example 4 | −48 | −45 | 6 |
| Example 5 | −45 | −44 | 2 |
| Example 6 | −33 | −32 | 3 |
| Example 7 | −35 | −33 | 6 |
| Example 8 | −28 | −27 | 4 |
| Example 9 | −40 | −39 | 3 |
| Comparative Example 1 | −31 | −3 | 90 |
| Comparative Example 2 | −27 | −5 | 81 |
| Comparative Example 3 | −45 | −22 | 51 |

What is claimed is:

1. Magnetic particles comprising:

magnetic core particles;

an intermediate layer formed on each surface of said magnetic core particles, comprising a silane-based coupling agent oligomer; and a resin composition layer formed on said intermediate layer, comprising a metal-based curing agent, a coupling agent and a silicone resin, and having an average particle size of 10 to 200 $\mu$m.

2. Magnetic particles according to claim 1, wherein the amount of said intermediate layer is 0.01 to 3% by weight based on the weight of said magnetic core particles, and the amount of said resin composition layer is 1 to 10% by weight based on the weight of said magnetic core particles.

3. Magnetic particles according to claim 1, wherein the amount of said metal-based curing agent is 0.05 to 1.0% by weight based on the weight of a solid content of said silicone resin, and the amount of said coupling agent is 0.1 to 20.0% by weight based on the weight of the solid content of said silicone resin.

4. Magnetic particles according to claim 1, wherein said silane-coupling agent oligomer is an amino-containing silane-based coupling agent oligomer, an epoxy-containing silane-based coupling agent oligomer or a mercapto-containing silane-based coupling agent oligomer.

5. Magnetic particles according to claim 1, wherein said metal-based curing agent is a metal alkoxide represented by the general formula:

$$(RO)_nM$$

wherein R is a $C_1$ to $C_{16}$ alkyl group; M is Al, Ti, Na, K, Ca, Zn or Fe; and n is an integer of 1 to 4.

6. Magnetic particles according to claim 1, wherein said coupling agent is a silane-based coupling agent, a titanium-based coupling agent or an aluminum-based coupling agent.

7. A magnetic carrier for an electrophotographic developer, comprising said magnetic particles as defined in claim 1.

8. A developer comprising said magnetic carrier as defined in claim 7 and a toner.

* * * * *